US007543904B2

(12) United States Patent
Izuo

(10) Patent No.: US 7,543,904 B2
(45) Date of Patent: Jun. 9, 2009

(54) PRINT HEAD INSPECTION METHOD, PRINT HEAD INSPECTION DEVICE AND A PRINTING DEVICE

(75) Inventor: Seiji Izuo, Shojiri (JP)

(73) Assignee: Seiko Epson Corporation, Tokyo (JP)

( * ) Notice: Subject to any disclaimer, the term of this patent is extended or adjusted under 35 U.S.C. 154(b) by 370 days.

(21) Appl. No.: 11/635,030

(22) Filed: Dec. 7, 2006

(65) Prior Publication Data

US 2007/0139461 A1 Jun. 21, 2007

(30) Foreign Application Priority Data

Dec. 8, 2005 (JP) ..... 2005-354935
Dec. 8, 2005 (JP) ..... 2005-354936
Dec. 8, 2005 (JP) ..... 2005-354937

(51) Int. Cl.
*B41J 29/393* (2006.01)

(52) U.S. Cl. ..... 347/19

(58) Field of Classification Search ..... 347/12, 347/15, 19, 29; 358/406, 504
See application file for complete search history.

(56) References Cited

U.S. PATENT DOCUMENTS 6,517,197 B2 * 2/2003 Hawkins et al. ..... 347/74
2007/0070110 A1 * 3/2007 Kim ..... 347/19
2007/0139460 A1 * 6/2007 Araki ..... 347/19

FOREIGN PATENT DOCUMENTS

JP 59-178256 A 10/1984

* cited by examiner

*Primary Examiner*—Lamson D Nguyen
(74) *Attorney, Agent, or Firm*—Sughrue Mion, PLLC

(57) ABSTRACT

A nozzle inspection device 50 includes: an inspection area 52 that is provided inside a capping member 41 and is capable of receiving ink; a voltage application circuit 53 that applies voltage to a print head 24 to generate a predetermined potential difference between the print head 24 and the inspection area 52; and a switching module 53*a* that is switched between the ground side where a nozzle plate has ground potential and the voltage-application side where the nozzle plate is independent from ground potential and voltage is applied to the print head. During a nozzle inspection to determine whether or not ink can be ejected from nozzles 23 on the basis of voltage variations in the inspection area 52, a CPU 72 switches the switch 53*a* to the voltage-application side. During printing, the CPU 72 switches the switch 53 to the ground side. In this structure, the print head is free from electrical impact during printing, and the head can be at a predetermined potential during a nozzle inspection.

8 Claims, 12 Drawing Sheets

PRINT HEAD INSPECTION METHOD, PRINT HEAD INSPECTION DEVICE AND A PRINTING DEVICE

BACKGROUND OF THE INVENTION

1. Field of the Invention

This invention relates to a print head inspection method, a print head inspection device and a printing device.

2. Description of the Related Art

A conventionally proposed print head inspection device includes an ink droplet-receiving area (ink receiving area) provided in a capping member opposite to a print head, near which a switch and a power supply are connected (e.g., JP A-59-178256). By turning on the switch and enabling the print head attain a predetermined potential, this device creates a predetermined potential difference between the print head and the ink receiving area, and charges ink droplets so as to be flown out from the nozzles. Then, the device detects variations in voltage that occur in the ink-receiving area, and thereby examines whether or not the nozzles of the print head are capable of ejecting ink.

SUMMARY OF THE INVENTION

However, the print head inspection device as described in JP A-59-178256 has given rise to a problem: as the device can only place the print head in an electrically isolated state or have it attain a predetermined potential, the print head may for instance, be affected by any static electricity that is produced on a recording sheet during printing.

The present invention has been made in the light of such a problem, and aims to provide a print head inspection device, a printing device, a print head inspection method and a program thereof, wherein a print head is free from electrical impact while printing takes place and wherein the print head can be at a predetermined potential during nozzle inspections.

A print head nozzle inspection method according to one aspect of the present invention is a method for inspecting a nozzle of a print head of a printing device, the printing device including a print head with a plurality of nozzles for ejecting print recording liquid, a print recording liquid-receiving area that is capable of receiving print recording liquid ejected from the nozzles, and a switching module that is used to switch the status of the print head between being at ground potential and being independent from ground potential, the print head inspection method including the steps of: (a) at the time of printing, driving the print head to eject print recording liquid while the print head is made at ground potential by use of the switching module; and (b) at the time of a nozzle inspection, generating a predetermined potential difference between the print head and the print recording liquid-receiving area while the print head is made independent from ground potential by use of the switching module, driving the print head to eject print recording liquid onto the print recording liquid-receiving area with the generated predetermined potential difference maintained, performs a nozzle inspection as to whether print recording liquid has been ejected from each of the nozzles in the print head based on results of detecting electrical change in the print recording liquid-receiving area or in the print head.

According to this print head inspection method, the print head is protected against the effects of static electricity generated in a print medium, by, for instance, having the print head remain at ground potential while printing takes place. During a nozzle inspection, the print head is separated from ground potential and the nozzles are made to eject print recording liquid onto the print recording liquid-receiving area in a state in which a predetermined potential difference has been developed between the print head and the print recording liquid-receiving area. The inspection of nozzles so as to determine whether or not individual nozzles have ejected print recording liquid is performed on the basis of the results of detecting any electrical changes in the print recording liquid-receiving area, or in the print head. Thus, the print head can be free from any electrical impact during printing, and at the same time it can attain a predetermined potential freely during a nozzle inspection.

In one preferable embodiment of the print head inspection method of the invention, the step (a) controls the switching module to make the print head at ground potential, and the step (b) controls the switching module to make the print head independent from ground potential.

In this preferable embodiment, the print recording liquid-receiving area may be provided within a capping member that caps the nozzles when the print head contacts with the capping member, and the step (b) may control the switching module to make the print head independent from ground potential when the nozzle inspection is performed while the print head and the capping member are opposed to each other.

In this preferable embodiment, the print recording liquid-receiving area may be provided in a flashing area that is capable of receiving print recoding liquid ejected in a flashing process in which print recording liquid is forcibly ejected, and the step (b) may control the switching module to make the print head independent from ground potential when a nozzle inspection is performed while the print head and the flashing area are opposed to each other.

In this preferable embodiment, furthermore, the step (a) prohibits generation of the predetermined potential difference between the print head and the print recording liquid-receiving area at the time of controlling the switching module to make the print head at ground potential, and the step (b) may generate the predetermined potential difference between the print head and the print recording liquid-receiving area at the time of controlling the switching module to make the print head independent from ground potential.

In the print head inspection method of the invention, the switching module may switch the status of the print head between being at ground potential and being at a specific potential which is independent from ground potential and keeps the predetermined potential difference from potential of the recording liquid-receiving area.

A print head nozzle inspection device according to one aspect of the invention is a device that inspects a nozzle of a print head, including: a print head with a plurality of nozzles for ejecting print recording liquid; a print recording liquid-receiving area that is capable of receiving print recording liquid ejected from the nozzles; a print head driving module that drives the print head to eject the print recording liquid from the nozzles; a potential difference generation module that makes the print head at a specific potential so as to generate a predetermined potential difference between the print head and the print recording liquid-receiving area; a electrical change detection module that detects electrical change in the print head or the print recording liquid-receiving area; a switching module that switches the status of the print head between being at ground potential and being independent from ground potential; and a control module that, at the time of printing, controls the print head driving module to drive the print head to eject print recording liquid for printing while the print head is made at ground potential by the switching module, and, at the time of a nozzle inspection, controls the potential difference generation module to generate the predetermined potential difference between the print head and the print recording liquid-receiving area while the print head is made independent from ground potential by the switching module, controls the print head driving module to drive the print head to eject print recording liquid onto the print recording liquid-receiving area with the generated predetermined potential difference maintained, and performs a nozzle inspection as to whether print recording liquid has been ejected from each of the nozzles in the print head based on electrical change detected by the electrical change detection module.

A printing device according to one aspect of the invention includes a print head with a plurality of nozzles for ejecting print recording liquid, and a print head nozzle inspection device of the invention described above.

A program of the present invention is to enable one or more computers to implement individual steps of the print head inspection method described above. The program may be stored in a computer readable recording medium (such as a hard disk, a ROM, an FD, a CD, or a DVD), delivered from one computer to another by way of transmission media (such as the Internet or a communications network such as LAN), or communicated in any other form. As individual steps of the print head inspection method described above can be executed either by enabling one computer to execute the program, or by enabling a plurality of computers to share and execute the respective steps, effects similar to those of the print head inspection method can be obtained.

BRIEF DESCRIPTION OF THE DRAWINGS

FIG. 4 (*a*) is a view of a print head 24 that is not opposed to the capping member 41. FIG. 4 (*b*) is a view of a print head 24 that is opposed to the capping member 41 and separated therefrom. FIG. 4 (*c*) is a view of a print head 24 that abuts on the capping member 41.

FIG. 11 (*a*) is a view in which a nozzle plate 27 is at ground potential. FIG. 11 (*b*) is a view of a nozzle plate 27 that is at a predetermined potential.

FIG. 12 (*a*) is a view of a nozzle plate that is at ground potential. FIG. 12 (*b*) is a view of a nozzle plate 27 that is separated from ground potential.

DESCRIPTION OF THE PREFERRED EMBODIMENTS

Figure 1:
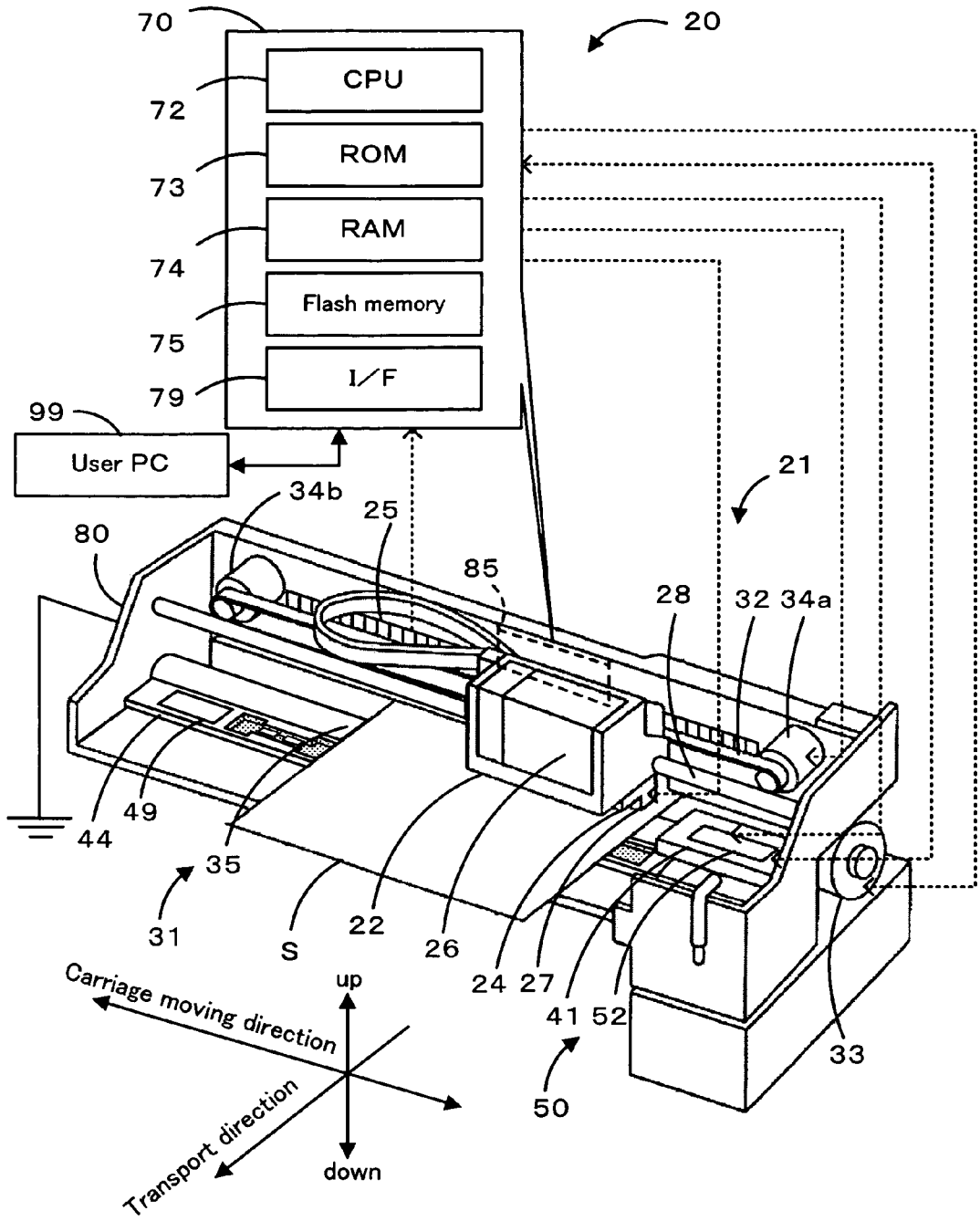
FIG. 1 is a block diagram illustrating an outline of a configuration of an ink jet printer 20.
Figure 2:
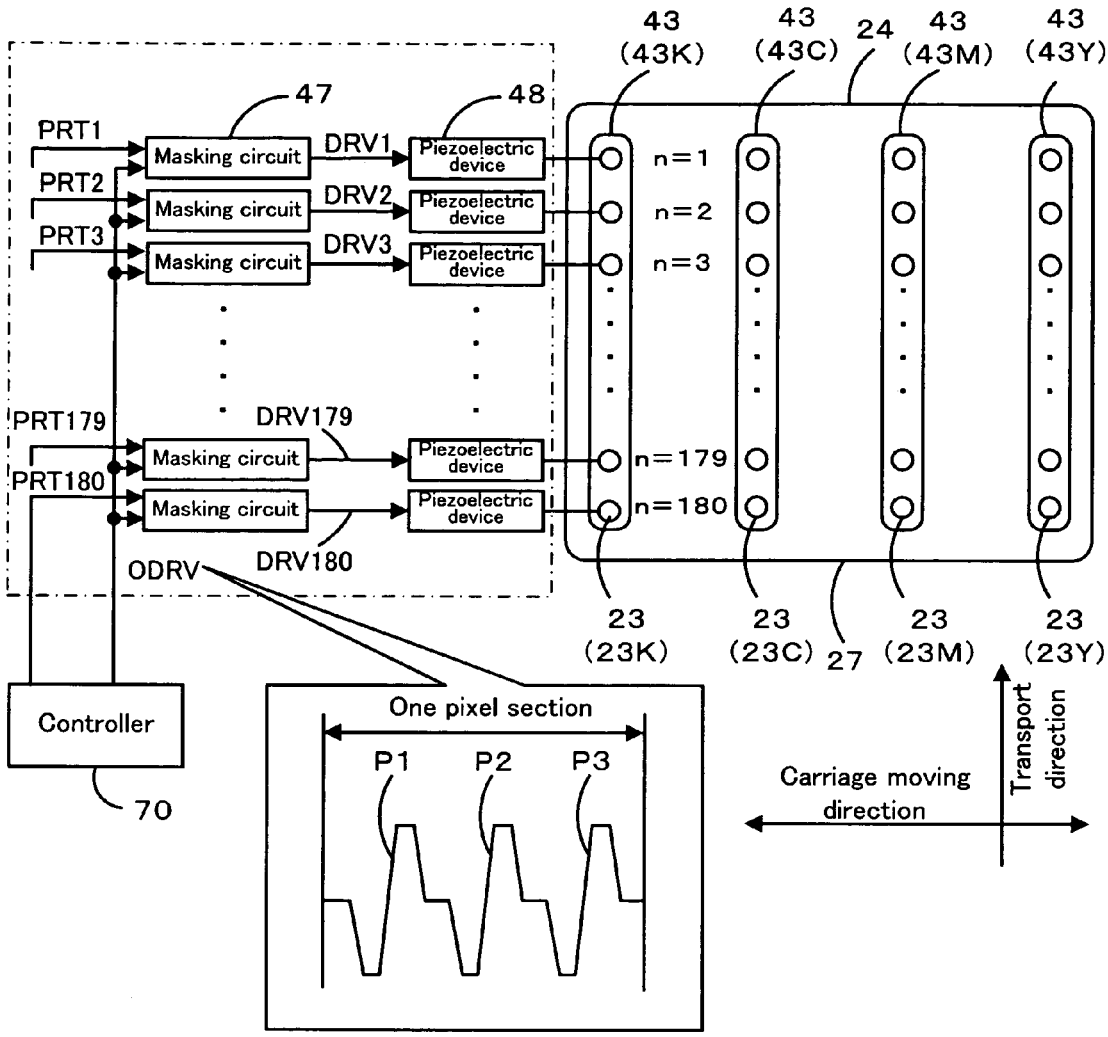
FIG. 2 is an illustration of a print head 24.
Figure 3:
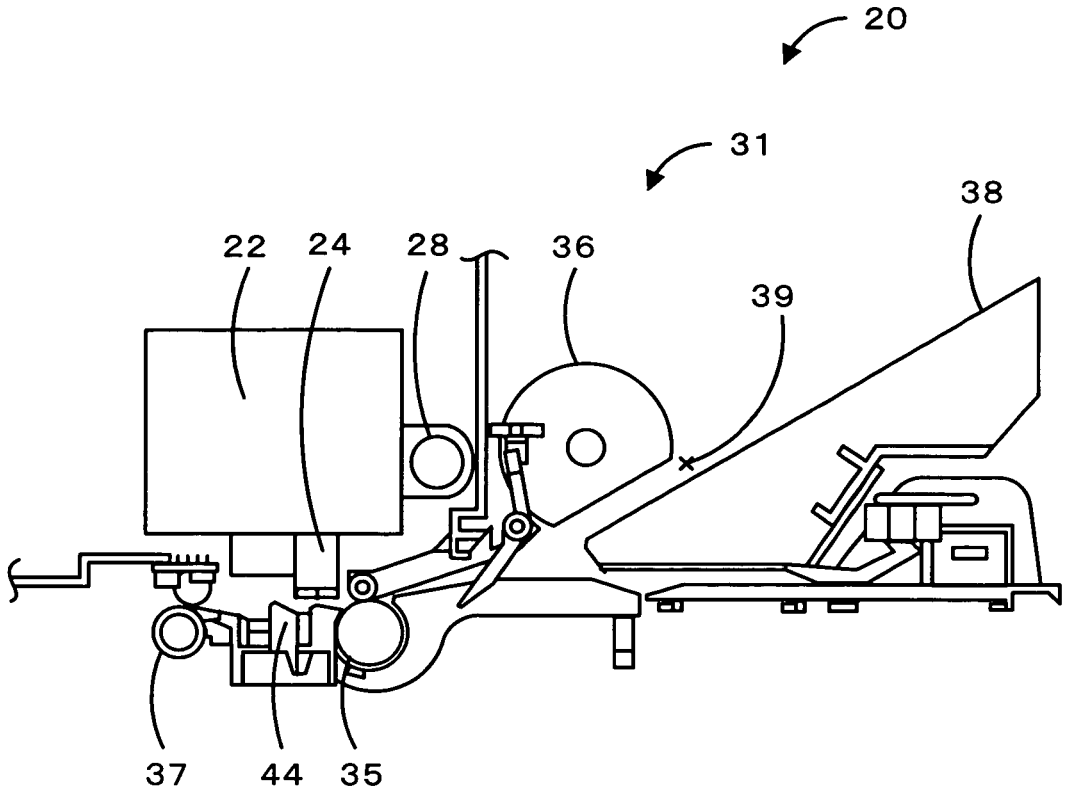
FIG. 3 is an illustration of a paper handling mechanism 31.
Figure 4:
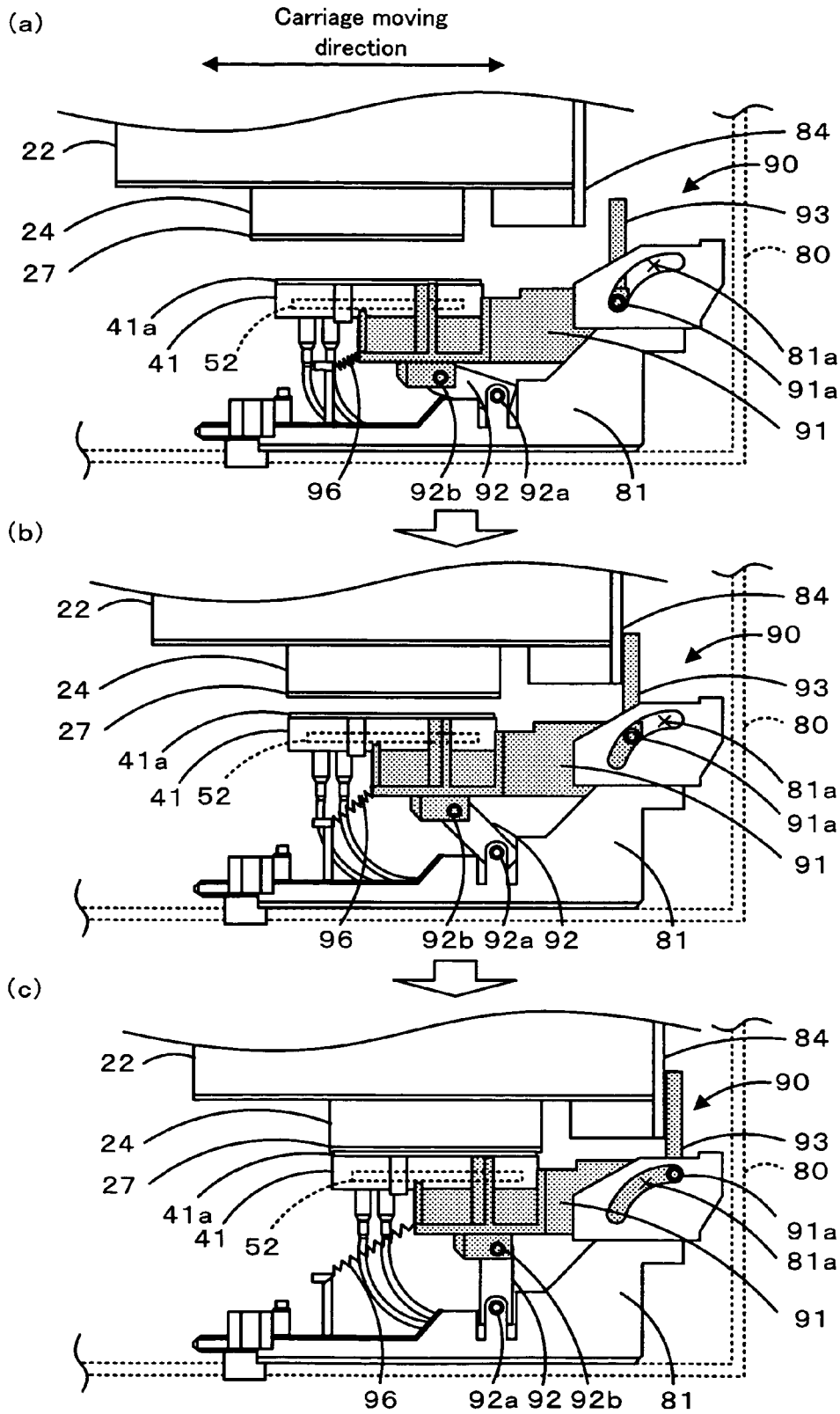
FIG. 4 is an illustration of a capping member elevator mechanism 90.
Figure 5:
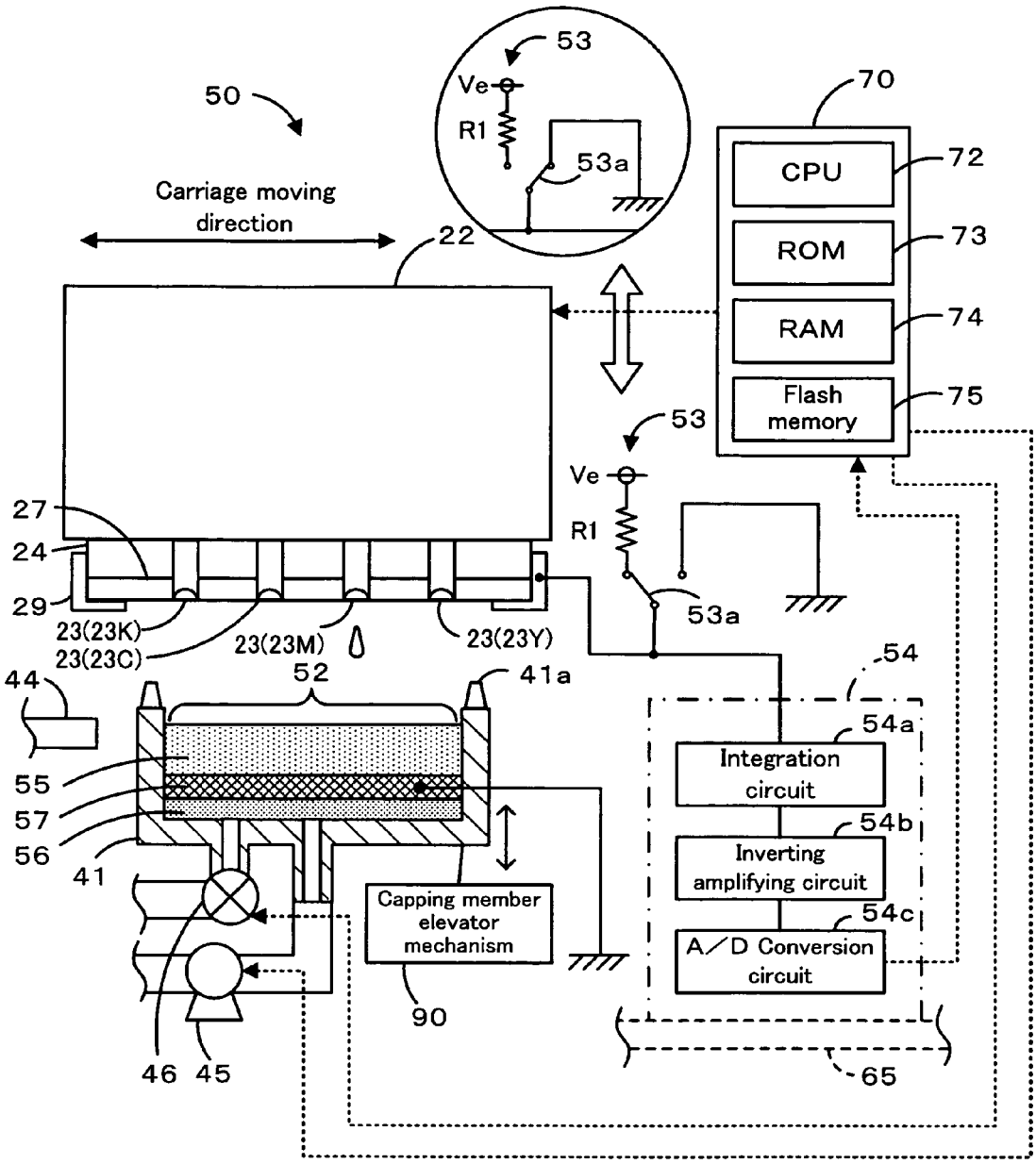
FIG. 5 is a block diagram illustrating an outline of a configuration of a nozzle inspection device 50.

One embodiment of the present invention will be described. FIG. 1 is a block diagram illustrating an outline of a configuration of an ink jet printer that is this embodiment. FIG. 2 is an illustration of an electrical connection of the print head 24. FIG. 3 is an illustration of the paper feed mechanism 31. FIG. 4 is an illustration of the capping member elevation mechanism 9, FIG. 4 (*a*) is a view of when the print head 24 and the capping member 41 are not opposed to each other, FIG. 4 (*b*) is a view of when the print head 24 is opposed to the capping member 41, and when they are spaced apart, and FIG. 4 (*c*) is a view of a print head 24 abuts the capping member 41. FIG. 5 is a block diagram illustrating an outline of a configuration of a nozzle inspection device 50.

As shown in FIG. 1, the ink jet printer 20 of this embodiment includes a printer mechanism 21 that performs printing by ejecting ink droplets from nozzles 23 of a nozzle plate 27 (See FIG. 2) onto a recording sheet S that is carried over a platen 44 from the back to the front, in FIG. 1, a paper feed mechanism 31 including a paper feed roller 35 that is driven by a driving motor 33, a capping member elevation mechanism 90 for raising and lowering the capping member 41 formed adjacent to the right end of the platen, the nozzle inspection device 50 that is formed inside the capping member 41 and that inspects whether or not ink droplets have been ejected normally from the print head, a flashing area 49 that is provided out of a printable area of the platen 44 and at the left end of the platen 44 as viewed in the Figure, and a controller 70 for controlling the entire ink jet printer 20. The flashing area 49 is used to carry out a so-called flashing operation that ejects ink droplets on a regular basis, or at predetermined timings and independent of printing data, in order to prevent ink at the tip of the nozzle 23 from drying and solidifying.

The printer mechanism 21 includes a carriage 22 reciprocating from side to side along a carriage shaft 28 by means of a carriage belt 32, ink cartridges 26 mounted on the carriage 22 and individually containing inks of various colors, respectively yellow (Y), magenta (M), cyan (C), and black (K), and a print head 24 for applying pressure onto each ink supplied from the ink cartridges 26. The carriage 22 travels along the carriage belt 32, installed between a carriage motor 34*a* mounted on the right side of a mechanical frame 80, and a driven roller 34*b*, mounted on the left side of the mechanical frame 80, is driven by the carriage motor 34*a*. On the backside of the carriage 22 a linear encoder 25 is positioned for detecting a position of the carriage 22, and this enables control of a position of the carriage 22. The ink cartridges 26 comprise containers (not shown), respectively containing cyan (C), magenta (M), yellow (Y) and black (K) ink for printing, inks that are composed of water as solvents and dyes, or pigments, as colorants, and that can be attached to, and removed from, the carriage 22.

As illustrated in FIG. 2, the print head 24 includes a nozzle plate on which a plurality of nozzles are punched. The nozzle plate 27 is fixed to the print head 24 by means of a frame-like cover head 29 (See FIG. 5). The nozzle plate 27 and the cover head 29 are made of conductive members (such as stainless steel). On the nozzle plate 27 are provided nozzle arrays 43 on which a plurality of nozzles 23 for ejecting respective colors of cyan (C), magenta (M), yellow (Y), and black (K) are arranged. Herein all nozzle arrays are collectively referred to as nozzles 23, and all nozzle arrays are collectively referred to as nozzle arrays 43. Cyan nozzles and the cyan nozzle array are referred to as nozzles 23C and nozzle array 43C; magenta nozzles and the magenta nozzle array as nozzles 23M and nozzle array 43M; yellow nozzles and the yellow nozzle array as nozzles 23Y and nozzle array 43Y; and black nozzles and the black array as nozzles 23K and nozzle array 43K. In the following step, nozzles 23K are described as an example. In the print head 24, the nozzle array 43K includes 180 nozzles 23K are arranged along a transport direction of a recording sheet S. In each nozzle 23K, a piezoelectric device 48 is provided as a driving element for ejecting ink droplets. Application of voltage deforms the piezoelectric device 48 and then pressurizes ink, thereby ejecting ink from the nozzles 23K.

The print head 24 includes a plurality of mask circuit 47 provided so as to correspond with the piezoelectric element 48 that drives the respective nozzles 23K, as shown in FIG. 2. An original signal ODRV or a print signal PRTn generated by the controller 70 is entered into the mask circuit 47. The letter n at the end of the print signal PRTn is a number that defines a nozzle included in a nozzle array. Since in this embodiment, a nozzle array consists of 180 nozzles, n is any integer value from 1 to 180. As shown in FIG. 2, within the spaces of one pixel (within the time in which the carriage 22 traverses an interval of one pixel) the original signal ODRV is composed of 3 drive waveforms of a first pulse P1, a second pulse P2 and a third pulse P3. In this embodiment an original signal ODRV having three drive waveforms as a repetition unit is referred to as one segment. When the original signal ODRV, or the print signal PRTn, is entered, on the basis of these signals, the mask circuit 47 outputs any necessary pulse of a first pulse P1, a second pulse P2 and a third pulse P3 as the drive signal DRVn (n means the same as that of the print signal PRTn), to the piezoelectric element 48 of the nozzles 23K. More specifically, when the mask circuit 47 outputs only a first pulse P1 to the piezoelectric element 48, one shot of ink droplets is ejected from the nozzles 23K, and small sized dots (small dots) are formed on the recording sheet S. In addition, when the mask circuit 47 outputs a first pulse P1 and a second pulse P2 to the piezoelectric element 48, two shots of ink droplets are ejected from the nozzles 23*k* and medium sized dots (medium dots) are formed on the recording sheet S. In addition, when the mask circuit 47 outputs the first pulse P1, the second pulse P2, and the third pulse P3 to the piezoelectric element 48, three shots of ink droplets are ejected from the nozzles 23K and large sized dots (large dots) are formed on the recording sheet S. In such a way, the ink jet printer 20 can form 3 sizes of dots by adjusting the amount of ink to be ejected during the interval of one pixel. Considerations similar to those of the nozzles 23K and nozzle array 43K described above, apply to the other nozzles 23C, 23M, and 23Y, or to the nozzle arrays 43C, 43M and 43Y. In addition, although in this context the print head 24 adopts the method of pressurizing ink by deforming the piezoelectric element 48, it may also adopt a method of pressurizing ink by means of air bubbles generated by applying voltage to a heat element (such as a heater) and heating ink.

As shown in FIG. 3, the paper feed mechanism 31 includes a recording sheet insertion port 39 through which a recording sheet S placed on the paper feed tray 38 is inserted; a paper feed roller 36 for supplying to the print head 24 the recording sheet S placed on the paper feed tray 38; a line feed roller 35 for carrying the recording sheet S or roll of paper; and a paper ejection roller 37 for ejecting a printed recording sheet S. The paper feed roller 36, the line feed roller 35 and the paper ejecting roller 37 are driven by the drive motor 33 (see FIG. 1) through a gear mechanism (not shown). The paper feed mechanism 31 prevents more than one recording sheet S from being fed at one and the same time, by a rotating drive force and frictional resistance of a separating pad (not shown). In FIG. 1, a transport direction of the recording sheet S is a direction from the back to the front, and the moving direction of the carriage 22 that moves with the print head 24 is the direction (main scanning direction) orthogonal to the transport direction of the recording sheet S.

As illustrated in FIG. 4, the capping member elevator mechanism 90 includes a capping unit frame 81 fixed to the right lower edge, as viewed in the Figure, in the mecha frame 80; a base member 91 which is connected to a capping member 41 and is supported so as to be able to move below a carriage 22 and above the capping unit frame 81; and an extension spring 96 that connects the capping unit frame 81 and the base member 91, and is constantly biasing the base member 91 in a lower left direction, as viewed in the Figure. In FIG. 4, for better understanding, the base member 91 is hatched. Although the two capping unit frames 81 stand respectively at the front and back, as viewed in the Figure, of the base member 91, only the capping unit frame 81 on the front side is illustrated in FIG. 4. At one end of the base member 91 is provided a columnar body 93 that extends in an upward direction so that it can abut on to an abutting section 84 formed at the right edge of the carriage 22, and on the other end, the capping member 41 is provided at a position that is opposed to the nozzle plate 27 when the abutting section 84 abuts onto the columnar body 93. In addition, a rod-like body 91*a* protruding to the front, as viewed in the Figure, is fixed to the lower end of the columnar body 93. One end of a link arm 92 is rockingly connected to the lower center of the base member 91 by way of the supporting shaft 92*b*. A turning shaft 92*a* that is fixed to almost the center of the capping unit frame 81 is inserted into the other end of the link arm 92. Thus, the link arm 92 is configured to be able to turn around the turning shaft 92*a* while supporting the base member 91. On both sides of the capping unit frame 81 is formed an arcuate groove 81*a* into which the rod-like body 91*a* is fitted so that it can move along the shape of the groove. In the capping member elevator mechanism 90, when the carriage 22 travels to the right, as viewed in the Figure, with the abutting section 84 abutting on the columnar body 93, the capping member 41 rises toward the print head 24 and the print head and the capping member move to the right while keeping the surface of the nozzle plate 27 of the print head 24 is horizontally opposed to the surface of an inspection area 52 in the capping member 41 (See FIG. 4 (*a*) to (*b*)). When the rod-like body 91*a* reaches the right end of the arcuate groove 81*a*, as viewed in the Figure, the capping member 41 is strongly pressed against the nozzle plate 27 (See FIG. 4 (*c*)). In the capping member elevator mechanism 90, when the carriage 22 travels to the left with the abutting section 84 abutting onto the columnar body 93, the capping member 41 descends away from the print head 24 while the surface of the nozzle plate 27 is kept horizontally opposed to the surface of the inspection area 52.

As illustrated in FIG. 5, the nozzle inspection device 50 includes a capping member 41 having an inspection area 52 onto which ink droplets that ejected from the nozzles 23 of the print head 24 can land; the inspection area 52 that is capable of receiving ink; a voltage amplification circuit 53 that generates a predetermined potential difference between the print head 24 and the inspection area 52 by making the print head 24 at a predetermined potential; and a voltage detection circuit 54 for detecting voltage changes in the print head 24.

The capping member 41, provided off to the right of the printable area of the platen 44 in FIG. 1, is an almost cuboid-shaped housing with the top opened, and a sealing member 41*a* made of insulating material such as silicon rubber is formed at the edge of the opening. The capping member 41 is used not only to inspect whether or not any nozzle is clogged, but also to seal the nozzles 23 so as to prevent them from drying at times when printing is halted. In addition, separately connected to the capping member 41 are a suction pump 45 and an opening and closing valve 46, and when the suction pump 45 is actuated while the opening and closing valve 46 is in a closed state, negative pressure is generated in the internal space of the capping member 41. Generation of negative pressure while the capping member 41 seals the nozzles 23 forcibly pumps ink out of the nozzles. A stretch tube is connected to the suction pump 45, or to the opening and closing valve 46.

The inspection area 52 includes an upper ink absorber 55 onto which ink droplets directly land, a lower ink absorber 56 that absorbs ink droplets penetrating downward after landing on the upper ink absorber 55, and a mesh-like electrode member 57 located between the upper ink absorber 55 and the lower ink absorber 56. The upper ink absorber 55 is made of a conductive sponge so as to have the same potential as the electrode member 57, and its surface serves as the inspection area 52. The sponge is highly permeable so that landing ink droplets can promptly travel downward, and a urethane sponge of an ester series (product name: Ever Light SK-E, manufactured by Bridgestone Corporation) is used herein. The lower ink absorber 56 is made of a non-woven fabric such as felt that has a higher degree of retention of ink than the upper ink absorber 55, and a non-woven fabric (product name: Kinocloth, manufactured by OJI KINOCLOTH CO., LTD.) is used herein. The electrode member 57 is formed as a grid-like mesh made of stainless metal (for instance, SUS). Thus, ink that has once been absorbed by the upper ink absorber 55 passes through the gaps in the grid-like electrode member 57, and is then absorbed and retained by the lower ink absorber 56. The electrode member 57 is grounded to have ground potential through the mechanical frame 80 (see FIG. 1). As the electrode member 57 is in contact with the conductive upper ink absorber 55, the surface of the upper ink absorber 55, i.e., the inspection area 52, is also at ground potential similarly to the electrode member 57.

The voltage application circuit 53 is connected to the cover head 29*a* and intensifies voltage amounting to a few volts, in electrical wiring laid inside the ink jet printer 20, to a predetermined potential Ve (several tens or hundreds of volts) by means of a booster circuit (not shown), and applies the intensified voltage to the nozzle plate 27 by way of the cover head 29. Between the booster circuit and the cover head 29, the voltage application circuit 53 includes a switch 53*a* that is switched between the ground side where the nozzle plate 27 is at the ground potential (See the area inside the circle in FIG. 5) and to the voltage-application side where voltage is applied and the nozzle plate 27 is independent from ground potential and at a predetermined potential. The voltage application circuit 53 makes the nozzle plate 27 at a predetermined potential through the cover head 29, thus making the print head 24 at the predetermined potential. The voltage detection circuit 54 is connected to the cover head 29 and detects variations in voltage at the nozzle plate 27 when ink is ejected. The voltage detection circuit 54 includes an integration circuit 54*a* that integrates and outputs voltage signals of the print head 24, an inverting and amplifying circuit 54*b* for inverting, amplifying and outputting signals outputted from the integration circuit 54*a*, and an A/D conversion circuit 54*c* for A/D converting signals outputted from the inverting and amplifying circuit 54*b* and outputting them to the controller 70. Since the change in voltage caused by the flight or landing of a single ink droplet can be minute, the integration circuit 54*a* integrates changes of voltage caused by the flights or landings of more than one ink droplets ejected from the same nozzles 23 and outputs the results in the form of a major change in voltage. The inverting and amplifying circuit 54*b* not only inverts pluses and minuses of variations in voltage, but also amplifies signals outputted from the integration circuit by means of a predetermined amplification rate that is determined by circuit configuration, and outputs them. The A/D conversion circuit 54*c* converts an analog signal outputted from the inverting amplifying circuit 54*b* into a digital signal, and then outputs it to the controller 70. The booster circuit (not shown), the voltage amplification circuit 53 and the voltage detection circuit 54 are provided on a carriage board 65 provided on a rear surface of the carriage 22.

As illustrated in FIG. 1, the controller 70 is provided on a main board 85 that is attached to the rear surface of the mecha frame 80, and is configured as a microprocessor centered around the CPU 72. The controller 70 includes a ROM 73 for storing various processing programs, a RAM 74 for temporarily saving or storing data, a flash memory 75 that is capable of writing and deleting data in and from, an interface I/F 79 for exchanging information with external devices, and input and output ports (not shown). The ROM 73 stores various processing programs such as a main routine, which will be describing later, a nozzle inspection routine, a cleaning process routine, and a print process routine. In the RAM 74 is provided a print buffer area in which print data that is sent from a user PC 99 through the I/F 79 is stored. To the controller 70, a voltage signal outputted from the voltage detection circuit 54 of the nozzle inspection device 50 and a position signal of the carriage 22 from the linear encoder 25 are inputted through the input port (not shown), and a print job outputted from the user PC 99 is inputted through the I/F 79. The controller 70 outputs, through the output port (not shown), a control signal to the print head 24 (including a mask circuit 47 or the piezoelectric device 48) or to the drive motor 33, a drive signal to the carriage motor 34*a*, or a control signal to the nozzle inspection device 50 (including the voltage amplification circuit 53 or switch 53*a*, a suctioning pump 45, and on-off valve 46), and print status information to the user PC 99 through the I/F 70.

Figure 6:
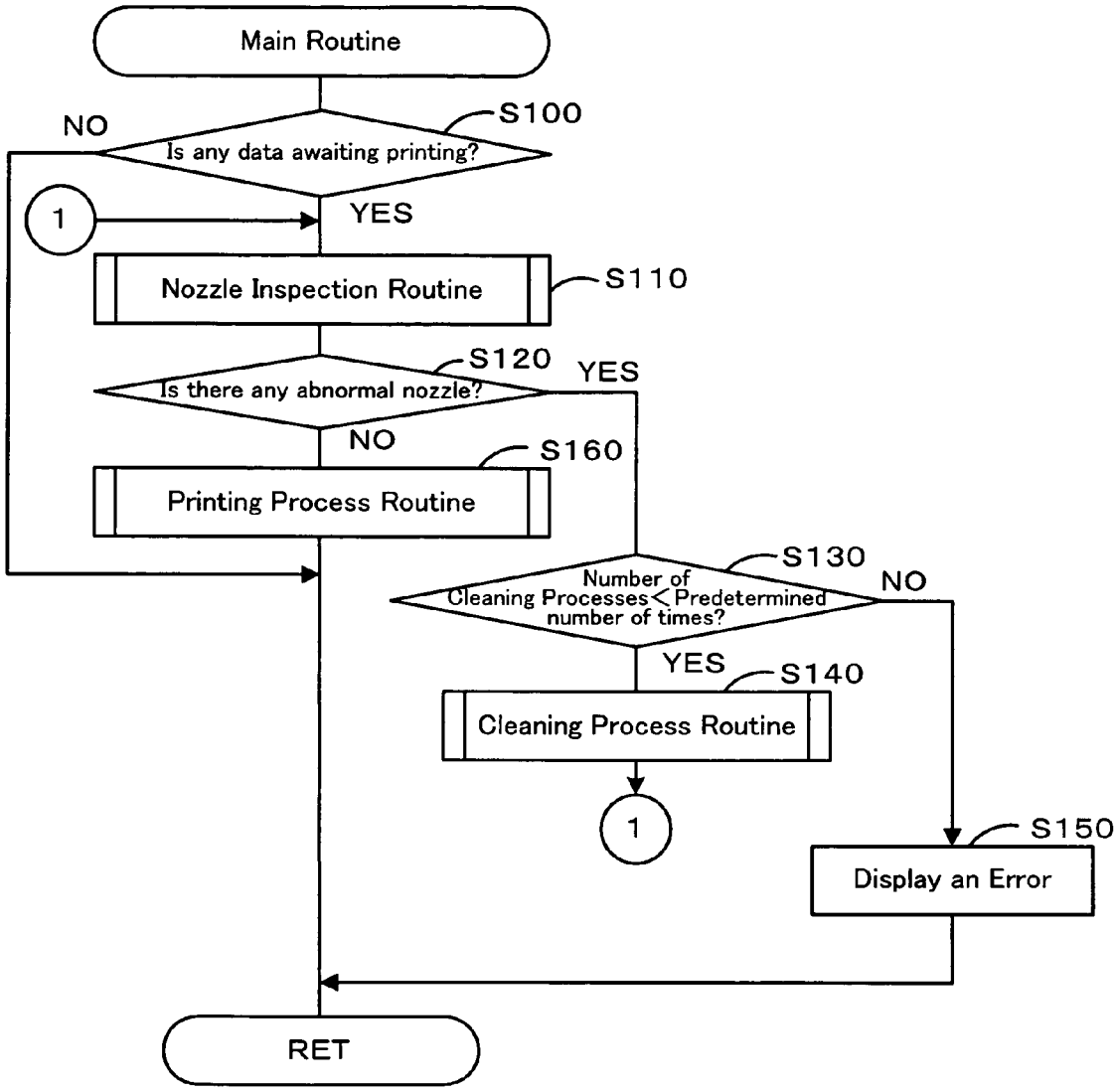
FIG. 6 is a flow chart illustrating one example of a main routine.

Next, an operation of an ink jet printer 20 of this embodiment thus configured will be described. First an operation of the main routine based on FIG. 6 will be described. FIG. 6 is a flow chart of the main routine executed by CPU 72 of the controller 70. After the ink jet printer 20 has been turned on, this routine is repeatedly executed by the CPU 72 at predetermined timings (for instance, every msec). When this routine begins, the CPU 72 judges first of all whether or not any print job is awaiting printing (Step S100). As a print job received from the user PC 99 is stored in the print buffer area formed in the RAM 74 and becomes a print job awaiting printing, at a time that a print job is received, when printing is under way, and even when printing can take place immediately, any print job becomes a print job awaiting printing. Moreover, if in step S100 no print job is awaiting printing, the main routine directly ends.

Figure 7:
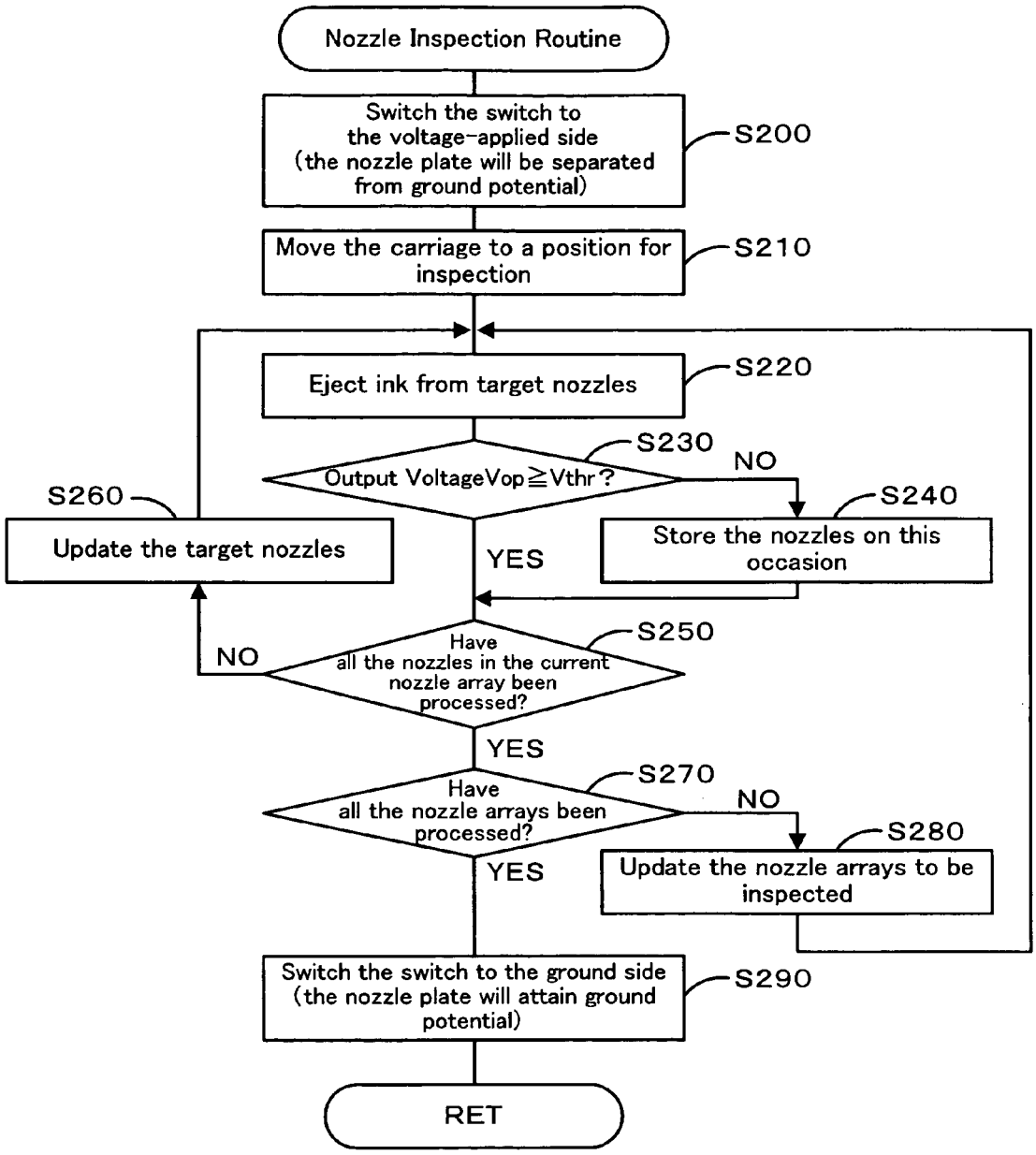
FIG. 7 is a flow chart illustrating one example of a nozzle inspection routine.

In step S100, when there is a print job in a printing queue, on the other hand, a nozzle inspection routine is performed for inspecting whether or not ink is being ejected from respective nozzles in a normal manner (Step S110). FIG. 7 is one example of a flow chart of the nozzle inspection routine. When the nozzle inspection routine begins, the CPU72 first switches the switch 53*a* of the voltage application circuit 53 to the voltage-application side where voltage is applied (step S200). The operation of the switch not only separates the nozzle plate 27 from ground potential, but also makes the nozzle plate 27 at a predetermined potential. Then, the CPU 72 drives the carriage motor 34*a* so as to move the carriage 22 to the extent that the print head 24 reaches an inspection position (Step S210). The inspection position is set to a home position (See FIG. 4 (*c*)) where the carriage 22 is located at the rightmost position of a carriage shaft 28, as viewed in FIG. 1.

When a nozzle inspection begins, the CPU 72 makes a nozzle 23, that is one of the nozzles included in a nozzle array 43 and is a target of the inspection, i.e., the ink ejecting target, eject ink through the masking circuit 47 and the piezoelectric device 48 thereof (See FIG. 2) (Step S220). Here, a nozzle inspection will be described in detail. In one test is conducted where, while the inspection area 52 is grounded to be at ground potential and a potential difference has been generated between the nozzle plate 27 and the inspection area 52, ink droplets were actually ejected from the nozzles 23. When the ink droplets were ejected, the output signal waveform of the print head 24 was represented as a sine curve. Although the principle whereby such an output signal waveform was obtained is unknown, is can be thought that this result attributes to a flow of an induced current due to electrostatic induction as charged ink droplets approach the inspection area 52. In addition, the amplitude of the output signal waveform from the print head 24 depended on the distance from the print head 24 to the upper ink absorber 55 (inspection area 52), as well as on the existence or non-existence of flying ink droplets and, where they exist, the sizes of the ink droplets. Thus, when ink droplets cannot fly out or are smaller than a predetermined size due to clogging of the nozzles 23, in comparison with normal cases, the amplitude of the output signal waveform becomes smaller or almost zero. Thus, it is possible to judge whether or not the nozzles 23 are clogged on the basis of the amplitude of the output signal. In this embodiment, as the amplitude of an output signal waveform generated by one shot of ink droplets was small even when ink droplets were of a predetermined size, ink droplets were ejected for 24 shots by performing eight times an operation of outputting all of the first to third pulses P1, P2, P3 of one segment that was representative of a drive waveform. In this manner, the output signal became an integrated value for 24 shots of ink droplets, and a sufficiently large output signal waveform could be obtained from the voltage detection circuit 54. The number of ink ejections may be set arbitrarily so that accuracy of inspection is assured. The target nozzles to be inspected are set in the order of nozzle number, starting with the nozzle 23Y (n=1).

When ink has been ejected from the target nozzle to be inspected, the CPU 72 judges whether or not the output voltage Vop that has been entered is greater than a threshold Vthr (Step S230). The threshold Vthr is an empirically defined value that should not be exceeded by the output voltage Vop (peak value) of the output signal waveform when 24 shots of ink are normally ejected or, when the 24 shots of ink are not ejected normally that should not be exceeded due to noise, etc. When the output voltage Vop is less than the threshold Vthr in Step S230, taking into consideration that abnormality such as clogging occurs at the nozzle 23, the CPU 72 stores in a predetermined area in the RAM 74, information specifying the nozzle 23 (information specifying for instance what nozzle in the nozzle array is involved) (Step S240).

After step S240, or when the output voltage Vop is not less than the threshold Vthr (that is, when the nozzles 23 are normal at this time) at Step S220, the CPU 72 judges whether or not all of the nozzles 23 included in the nozzle array 43 that are at that time being inspected have been inspected (Step S250). When any nozzle 23 in the nozzle array 43 remains uninspected, the CPU 72 updates the target nozzle to be inspected with the uninspected nozzle (step S260), and then executes the processes after Step S220. On the one hand, when it is determined in step S250 that all the nozzles included in the nozzle array 43 have been inspected, the CPU 72 judges whether or not all the nozzle arrays included in the print head 24 have been inspected (Step S270). When any nozzle array 43 remains uninspected, the CPU 72 updates the target nozzle array to be inspected with the nozzle array 43 that remains uninspected (Step S280), and then executes the processes after Step S220. On the other hand, when it is determined in Step S270 that all the nozzle arrays 43 included in the print head 24 have been inspected, the CPU 72 switches the switch 53*a* of the voltage application circuit 53 to the ground side, as shown in the circle in FIG. 5 (Step S290), and terminates the nozzle inspection routine. By this switch control, the nozzle plate 27 is independent from the predetermined potential and become ground potential. When any nozzle 23 among all the nozzles 23 arranged in the print head 24 is abnormal, information specifying that nozzle 23 is stored in a predetermined area of the RAM 74. No information is stored when none of the nozzles 23 is abnormal.

Referring back to the main routine of FIG. 6, after executing the nozzle inspection routine described above (Step S110), the CPU 72 judges whether or not any nozzle 23, among all the nozzles 23 arranged in the print head 24, is abnormal on the basis of storage contents of the predetermined area in RAM 74 (Step S120). When any abnormal nozzle 23 exists, the CPU 72 deems that clogging has caused the abnormality and performs cleaning of the print head 24. However, in advance of cleaning of the print head, the CPU 72 judges whether or not the number of cleaning processes that need to be conducted to clear the abnormality has reached an upper limit (for instance, 3 times) (Step S130). Then, when the number of cleaning processes is less than the upper limit, the CPU 72 performs the cleaning process of the print head 24 (Step S140). More specifically, the CPU 72 closes the on-off valve 46 and drives the suctioning pump 45 to generate negative pressure inside the capping member 41. Thus, ink in the nozzle 23 being sucked and ejected. Execution of the cleaning process can remove ink that has accumulated in the nozzles 23 (for instance, ink of an increased viscosity because it has been remained in the nozzle for a long time).

Returning to the main routine in FIG. 6, after performing the cleaning process in Step S140, the CPU 72 returns to the nozzle inspection routine at Step S110 to check whether or not the abnormality of the nozzle 23 has been rectified. In this step S110, although only on abnormal nozzle 23 may be re-inspected, all of the nozzles in the print head 24 are in fact re-inspected because nozzles that were normal during cleaning may for some reasons, be clogged. When the number of cleaning processes that have been conducted at Step S130 has reached an upper limit, the CPU 72 deems that cleaning cannot normalize the abnormal nozzle 23, displays an error message to that effect on the operation panel (not shown) (Step S150), and terminates the main routine. When no abnormal nozzle exists at Step S120, the CPU 72 performs the print process routine (Step S160), and then terminates the main routine.

Figure 8:
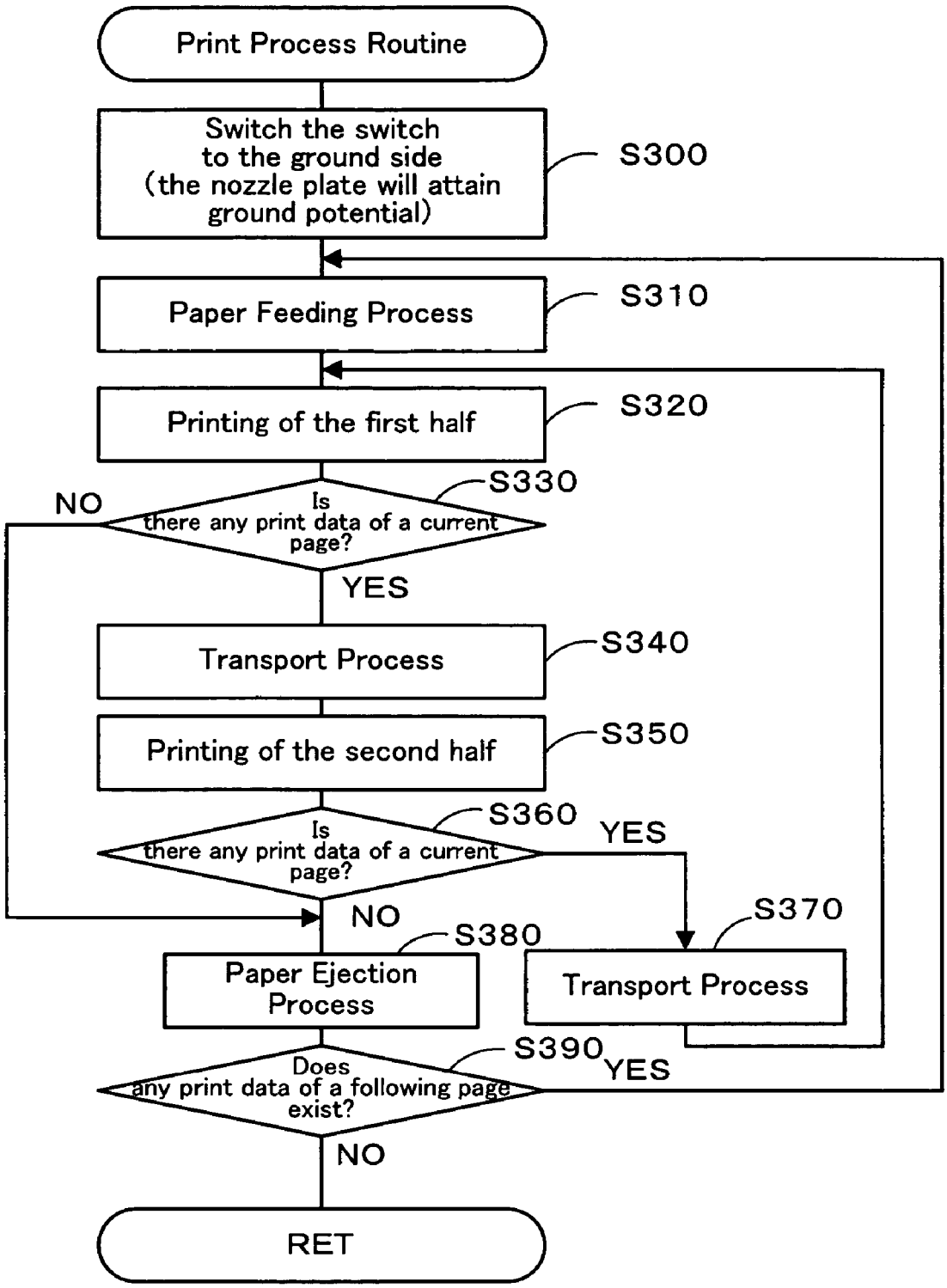
FIG. 8 is a flow chart illustrating one example of a print process routine.

FIG. 8 is a flowchart of the print process routine. When the print process routine begins, the CPU 72 first switches the switch 53*a* of the voltage application circuit 53 to the ground as shown in the circle in FIG. 5 (Step S300). The nozzle plate 27 is connected to the ground, and even when static electricity is generated on the recording sheet S, the static electricity is led to the ground. Next, the CPU 72 performs the paper feed process, specifically, the CPU 72 rotates and drives a paper feed roller 36 (See FIG. 3) by means of a driving motor 33, and transports a recording sheet S that is placed on the paper feed tray 38 (Step S310) to the paper handling roller 35. Then, the CPU 72 causes the print head 24 to eject ink while moving the carriage 22, by driving the carriage motor 34*a*, from the home position to the left, as viewed in FIG. 1, and performs the first half of the printing on the basis of printing data (Step S320). The CPU 72 judges whether or not any print data still remain to be printed on the recording sheet S that is now being printed (Step S330). When any data to be printed on the recording sheet S now being printed exist, the CPU 72 performs a transport process of rotating and driving the paper handling roller 35, and transporting the recording sheet for a predetermined distance (Step S340), causes the print head 24 to eject ink while moving the carriage 22 to the right, as viewed in FIG. 1, by driving the carriage motor 34*a*, and performs the second half of the printing on the basis of the printing data (Step S350). Next, the CPU 72 judges whether or not any print data still remain to be printed on the recording sheet S that is now being printed (Step S360). When any data to be printed on the recording sheet S now being printed exist, the CPU 72 performs the transport process of rotating and driving the paper handling roller 35, and transporting the recording sheet S for a predetermined distance (Step S370), and performs the processes after Step S320. On the other hand, when no print data to be printed on the recording sheet now being printed exists in Step S330 or in Step S360, the CPU 72 performs a paper ejection process of rotating and driving a paper ejection roller 37 and ejecting the recording sheet S onto the catch tray (Step S380). After Step S380, the CPU 72 judges whether or not any print data exists for a subsequent page (Step S390). When any print data of a following page exists, the CPU 72 returns to Step S310. When no print data of a following page exists, the CPU 72 terminates the print process routine. Thus, even when static electricity is generated on the recording sheet S, the static electricity is led to the ground because ink is ejected while the nozzle plate 27 is kept at ground potential. In addition, since the print process takes place after the nozzle inspection and the cleaning process, the print process can be performed in a condition in which ink can be ejected from all the nozzles 23.

Here, the relationship between components of the present embodiment and those of the present invention will be described. The inspection area 52 of this embodiment corresponds to the print recording liquid-receiving area. The mask circuit 47 and the piezoelectric device 48 correspond to the print head drive module. The voltage application circuit 53 corresponds to the potential difference generation module. The switch 53*a* corresponds to the switching means. The voltage detection circuit 54 corresponds to the electrical change detection module. The paper handling mechanism 31 corresponds to the transport module. The CPU 72 corresponds to the control module. The ink corresponds to the print recording liquid of this invention. In this embodiment, one example of the print head inspection method of the present invention will also be clarified by describing an operation of the ink jet printer 20.

According to the ink jet printer 20 of the present embodiment described above in detail, by making the print head 24 at ground potential while printing takes place, the print head 24 is protected against any adverse effects of static electricity generated on a recording sheet S. During a nozzle inspection, ink is ejected from the nozzles 23 to the inspection area 52 in a state which the print head 24 is independent from ground potential and a predetermined potential difference has been generated between the print head 24 and the inspection area 52, and the nozzle inspection is performed on the basis of the results of detection performed by the voltage detection circuit 54. Thus, during printing, the print head 24 can be free from any electrical impact, while during a nozzle inspection, the print head 24 can be a predetermined potential. In a case where the print head 24 is connected to the ground and the inspection area 52 is at the predetermined potential, there is a risk of electric current leaking by way of the platen 44 because ink has accumulated in the inspection area 52 and a desirable potential difference is not generated between the print head 24 and the inspection area 52. There is no such risk in the embodiment described above, since the inspection area 52 is grounded to the ground potential and the print head is at the predetermined potential during nozzle inspection. In addition, as the inspection area 52 is provided within the capping member 41, ink ejected during a nozzle inspection can be easily disposed. Furthermore, as one switch 53*a* has the capability of switching between ground potential and a predetermined potential, the configuration can be simplified. In the embodiment described above, when the switch 53*a* is controlled to make the print head is independent from ground potential, a potential difference is generated between the print head 24 and the inspection area 52 the voltage application circuit 53. On the other hand, when the switch 53*a* is controlled to make the print head 24 at ground potential, a potential difference is not generated between the print head 24 and the inspection area 52. This structure reduces the time during which the print head 24 is maintained at the predetermined potential, and prevents degradation of ink due to remaining in the print head 24 at the predetermined potential.

It goes without saying that, the present invention is not limited to the embodiments described above, and that it can be carried out in a variety of embodiments, as long as they remain confined to the technical range of this invention.

Figure 9:
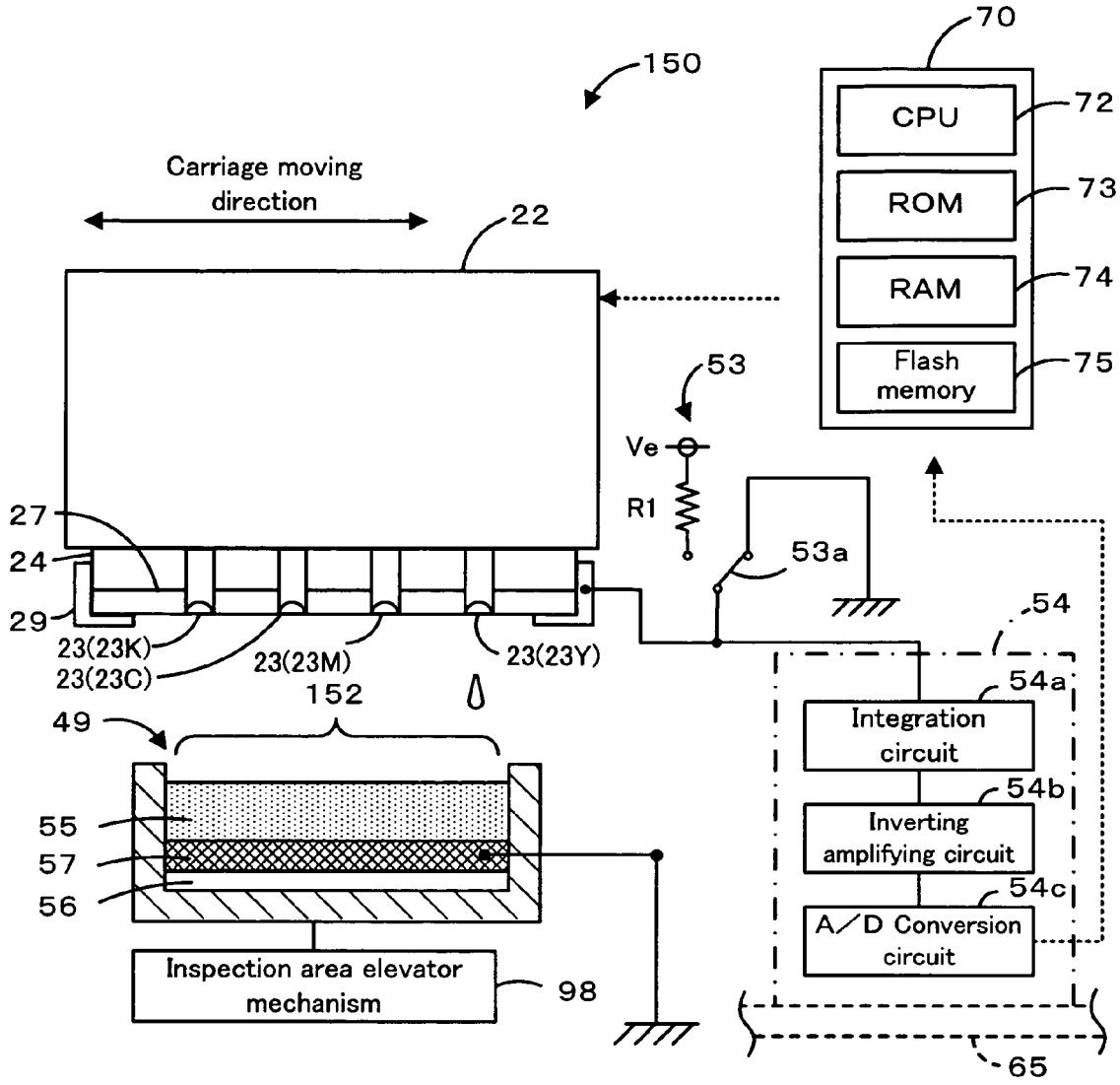
FIG. 9 is an illustration of another nozzle inspection device 150.

In the embodiment described above, a nozzle inspection device 50 has the inspection area 52 which is provided inside the capping member 41. As illustrated in FIG. 9, a nozzle inspection device 150 may have an inspection area 52 which is provided inside a flashing area 49. FIG. 9 is an illustration of another nozzle inspection device 150. In this case, an inspection area elevator mechanism 98 for elevating the inspection area 152 may be provided in the flashing area 49 and may move the inspection area to approach the print head 24, before performing a flashing process. The inspection area elevator mechanism 98 may be the same as the capping member elevator mechanism 90 of the above embodiment, or may have a different mechanism that elevates the inspection area in only an up and down direction. In this manner, as the inspection area 52 is provided in the flashing area 49, ink ejected during a nozzle inspection can be easily disposed. The inspection area elevator mechanism may be otherwise omitted. The inspection area 52 may be independently provided adjacent to the flashing area 49, or may be provided as an ink-receiving area formed on the platen in borderless printing. Even in such cases, the print head 24 can be free from electrical impact during printing, and the print head can freely be a predetermined potential during a nozzle inspection.

In the embodiment described above, a switch 53*a* is used for switching the status of the print head between being at ground potential and being at a predetermined potential. In one modified structure, there may be two switches, that is, a first switch for switching the status of the print head 24 between being at ground potential and being independent from ground potential, and a second switch for switching the status of the print head 24 between being at a predetermined potential and being independent from the predetermined potential. The print head 24 can be free from electrical impact during printing also in this structure, and the print head can freely be a predetermined potential during a nozzle inspection. In this case, when the first switch is controlled to make the print head 24 is independent from ground potential, the second switch is controlled so that the voltage application circuit 53 generates a predetermined potential difference between the print head 24 and the inspection area 52. When the first switch is controlled to make the print head at ground potential, the second switch controlled so as to prevent the voltage application circuit from generating a predetermined potential difference between the print head 24 and the inspection area 52. This structure reduces the time during which the print head 24 is maintained at the predetermined potential, and prevents degradation of ink due to remaining in the print head 24 at the predetermined potential.

Figure 10:
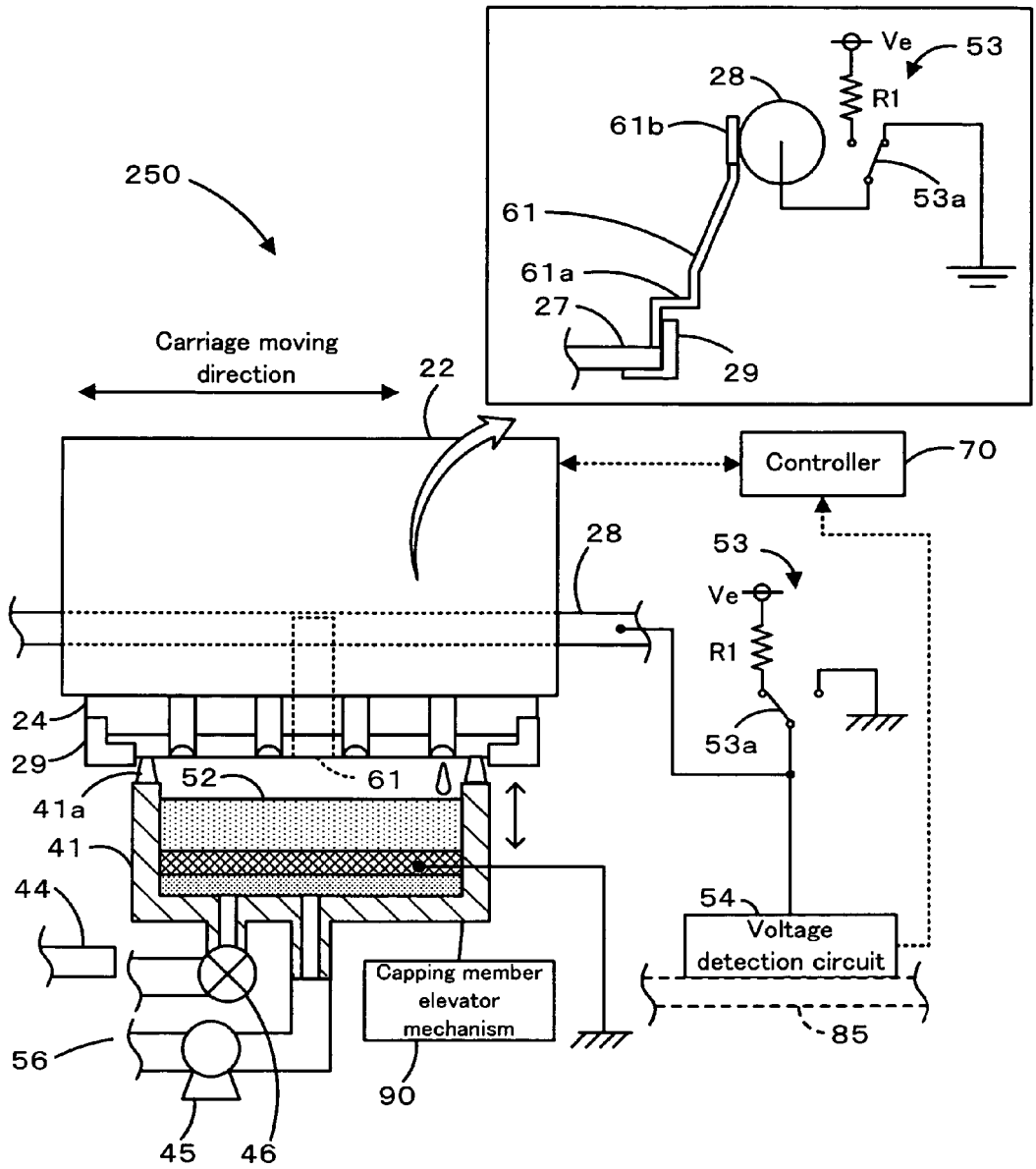
FIG. 10 is an illustration of another nozzle inspection device 250.

In the embodiment described above, the nozzle inspection device 50 has the voltage application circuit 53 which is connected to the cover head 29, and makes the nozzle plate 27 at a predetermined potential through the cover head. In one modified structure as shown in FIG. 10, a nozzle inspection device 250 may be provided where the voltage application circuit 53 is arranged at a main board 85 and connected to a conductive carriage shaft 28. The nozzle inspection device 250 uses a contact plate 61, which is a plate-like member formed of a member conductivity and flexibility (such as stainless steel) and is electrically connected to the carriage shaft 28 and to the nozzle plate 27, to switch the nozzle plate to ground potential or to a predetermined potential. At one end of the contact plate 61 is provided a contact section 61*b* that is a rocking free end and is fixed to a nozzle plate 27 by a fixed part 61*a* of the other end of the contact plate, in such a way that the contact section 61*b* is constantly biased to the carriage shaft 28. In this way, the configuration of the carriage 22 can be simplified.

Figure 11:
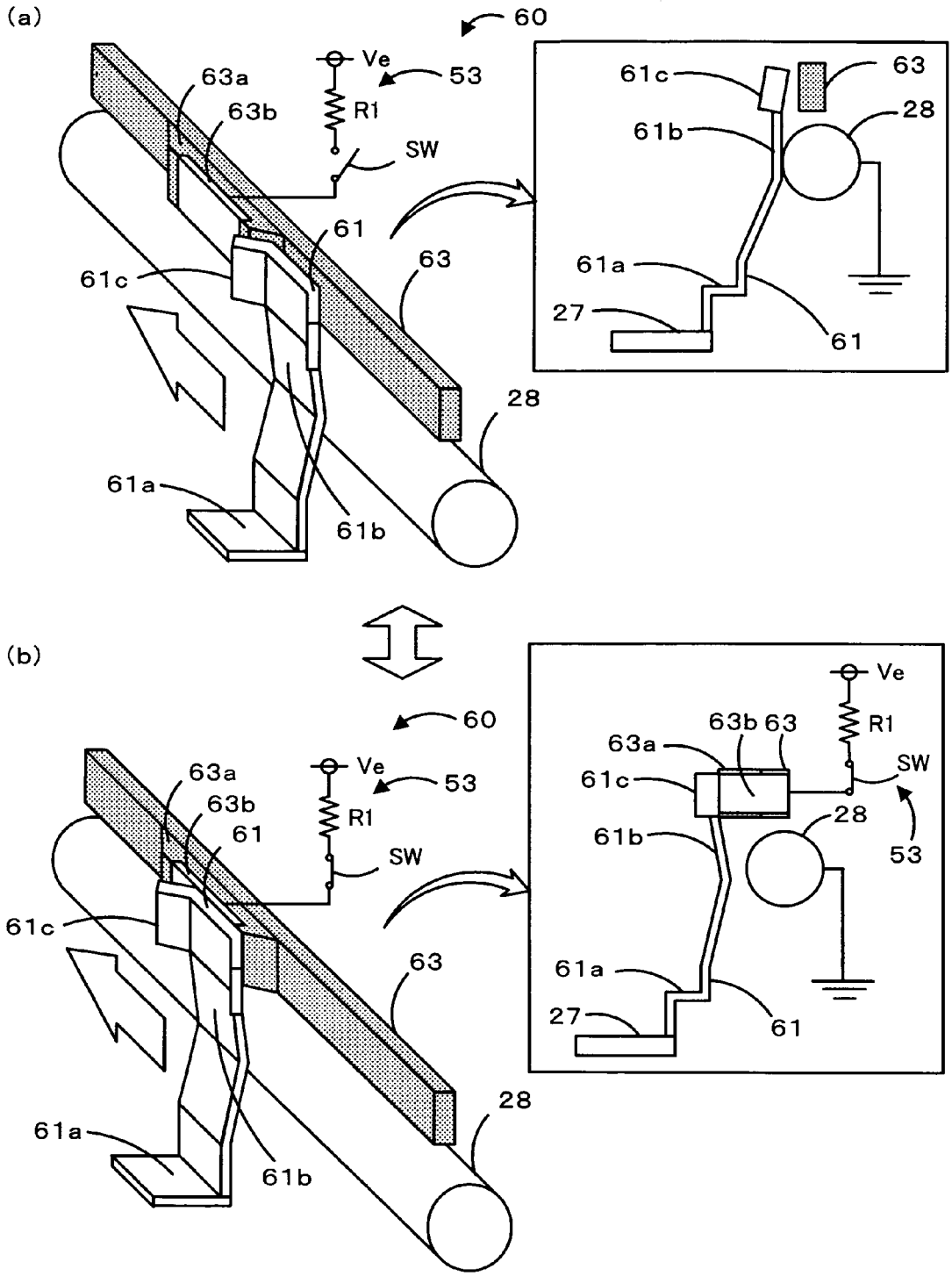
FIG. 11 is an illustration of a potential switching mechanism 60.

In the embodiment described above, the nozzle plate 27 is switched to ground potential or to a predetermined potential, by means of the electrical switch 53*a*. In one modified structure as illustrated in FIG. 11, switching of the status of the nozzle plate 27 to ground potential or to a predetermined potential may be effected by means of a potential switching mechanism 60 as a structural switch. FIG. 11 is an illustration of the potential switching mechanism 60. FIG. 11 (*a*) is a view in which the nozzle plate 27 is at ground potential. FIG. 11 (*b*) is a view in which the nozzle plate 27 is at a predetermined potential. The potential switching mechanism 60 includes the contact plate 61 described above (See FIG. 10); and a guide member 63 that is formed of an insulating material such as resin and provided in the upper vicinity of the carriage shaft 28 and from the right edge to the left edge in the mecha frame 80 (See FIG. 1). The guide member 63 include: a trapezoid-shaped protrusion 63*a* that is provided in an area in which the print head 24 is independent from ground potential (in this case, an area in which a nozzle inspection is performed, and hereinafter referred to as a potential independence area) separates further the carriage shaft 28 from the contact shaft 61 as the carriage 22 (See FIG. 1) travels; and an electrode plate 63*b* that is electrically connected to the voltage application circuit 53 and is provided on a surface of the protrusion 63*a*, which is to contact with the contact plate 61. The carriage shaft 28 is formed of a conductive material (such as stainless steel) and is grounded to the ground by means of the mecha frame 80 (See FIG. 1). At the upper end of the contact plate 61, a rocking section 61*c* is provided in a contactable manner with the protrusion 63*a* when the carriage 22 travels along the carriage shaft 28. When the rocking section 61*c* contacts with the protrusion 63*a*, the contact plate 61 flexes to the rear side of the print head 24, thereby separating further the contact plate 61 from the carriage shaft 28. In such a potential switching mechanism 60, when the contact plate 61 is not in contact with the protrusion 63*a*, the nozzle plate 7 is grounded to the ground by means of the contact plate 61 as shown in FIG. 11 (*a*). And as illustrated in FIG. 11 (*b*), when the contact plate 61 is in contact with the electrode plate 63*b* of the protrusion 63*a*, voltage is applied to the nozzle plate 27 by means of the electrode plate 63*b* and the contact plate 61. In this structure, the switch SW of the voltage application circuit 3 may be omitted, and voltage may be constantly applied to the electrode plate 63*b*. In other words, switch control of the voltage application circuit 53 may be omitted. In this way, control of the print process and the nozzle inspection can be simplified. Further, even without switch contact, as voltage is being applied to the nozzle plate 27 only when the print head 24 is located in the potential independence area, ink degradation resulting from voltage application can be inhibited.

Figure 12:
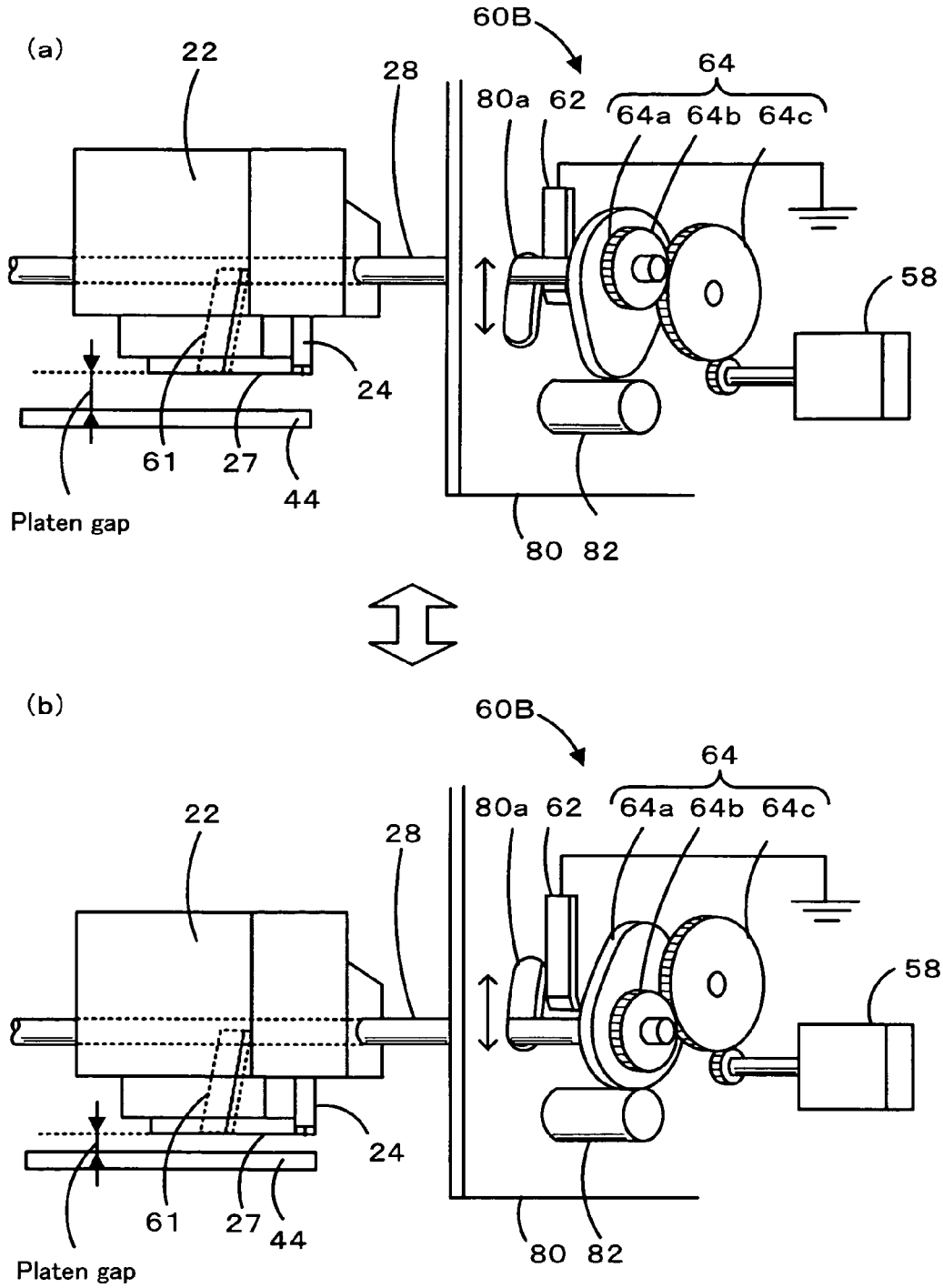
FIG. 12 is an illustration of a potential switching mechanism 60B.

In another modified structure, the nozzle plate 27 may be switched between being at ground potential and being independent from ground potential, by means of a potential switching mechanism 60B as a mechanical switch, as illustrated in FIG. 12. FIG. 12 is an illustration of the potential switching mechanism 60B. FIG. 12 (*a*) is a view in which the nozzle plate 27 is at ground potential. FIG. 12 (*b*) is a view in which the nozzle plate 27 is independent from ground potential. The potential switching mechanism 60B includes: a contact plate 61 that connects the carriage shaft 28 and the nozzle plate 27 electrically, the carriage shaft 28 being supported in a movable manner in up and down direction by an arcuate shaft movement groove 80*a* that is formed on both sides of the mecha frame (only one side being illustrated); a platen gap-adjusting mechanism 64 that causes an adjusting motor 58 to drive a cam 64*a*, and gears 64*b* and 64*c* in order to vary distance between the shaft of the cam 64*a* and a supporting pin 82, and adjusts the distance between the print head 24 and the platen 44 (hereinafter referred to as a platen gap); and a connection switching mechanism 62 that is formed to have a length enough to electrically contact the carriage shaft 28 at a predetermined platen gap distance, and can connect and disconnect the carriage shaft 28 to and from ground potential as the carriage shaft 28 moves up and down. In the potential switching mechanism 60B, when the carriage shaft 28 and the connection switching member 62 are fixed in a contacting manner with each other by the platen gap-adjusting mechanism 64, the nozzle plate 27 and the carriage shaft 28 reaches ground potential (See FIG. 12(*a*)). On the other hand, in this potential switching mechanism 60B, when the carriage shaft 28 and the connection switching member 62 are fixed in a non-contacting manner with each other by the platen gap adjustment mechanism 64, the nozzle plate 27 and the carriage shaft 28 are independent from ground potential (FIG. 12 (*b*)). It is preferable that the distance that prevents contact of the carriage shaft 28 with the connection switching member 62 is the shortest distance that can be changed by the platen gap adjusting mechanism 64 (See FIG. 12 (*b*)). In this way, it is also possible to protect the print head 24 from electrical impact during printing, while at the same time enabling the print head 24 to reach a predetermined potential during a nozzle inspection. In addition, an insulating film may be formed in a predetermined area of the connection switching member 62, and the platen gap-adjusting mechanism 64 may bring the insulating film into contact with the carriage shaft 28, so as to make the nozzle plate be independent from ground potential. The ink jet printer 20 may employ a potential switching mechanism that switches the status of the nozzle plate 27 between being at ground potential or being independent from ground potential, according to a position of the print head 24.

When an open sensor detects that a print cover, which is formed to cover a print mechanism 21, has been opened, for example, by a user while the voltage application circuit 53 applies the a predetermined voltage to the nozzle plate 27, the switch 53*a* may be controlled to make the nozzle plate 27 at ground potential, though the situation is not specifically described. In this manner safety level can be enhanced because the nozzle plate 27 is kept at ground potential even when the printer cover has been opened while voltage is being applied to the print head 24 and the inspection area 52.

In the embodiment described above, ink in the print head 24 is charged to have a predetermined potential by means of making the nozzle plate 27 to have a predetermined potential. The way of charging ink is not limited to this method. For example, ink in the print head 24 may be charged to have a predetermined potential by causing a cavity plate (not shown), which forms an ink chamber of the print head 24, to have a predetermined potential, or directly by inserting an item such as an electrode bar into the ink in the print head 24.

In the embodiment described above, the nozzle inspection routine is executed at Step S110 when any print data is awaiting printing in step S100 of the main routine. In a modified structure, the head inspection routine may be executed every time the frequency of movement by the carriage 22 reaches a predetermined frequency (for instance, every 100 passes), or at predetermined intervals (such as every other day or every other week), or in response to an instruction from a user to execute the nozzle inspection routine, via the operation panel (not shown). In addition, the nozzle inspection routine may be executed at a time of inspection of the ink jet printer 20 prior to shipment.

In the embodiment described above, the voltage detection circuit 54 detects an output signal waveform of the nozzle plate 27. The voltage detection may be performed by a voltage detection circuit which is similar to the voltage detection circuit 54, and prepared instead of or in addition to the voltage detection circuit 54, and is connected between the electrode member 57 and the ground to detect an output signal waveform of the inspection area 52. In such case, when a potential difference is generated between the inspection area 52 and the nozzle plate 27 during a nozzle inspection, either the inspection area 52 may be grounded to the ground, and voltage applied to the nozzle plate 27, or the nozzle plate 27 may be grounded to the ground, and voltage applied to the inspection area 52.

In the embodiment described above, the capping member 41 approaches, or moves away from, the print head 24 as the carriage 22 travels from side to side, the capping member elevation mechanism 90. The structure of a capping member elevation mechanism is not limited as long as the mechanism can move the capping member 41 vertically. For instance, a capping member 41 may be located at the home position, and a capping member elevation mechanism may include a slider that vertically slides the linear guide by means of a ball screw causes the capping member 41 to ascend and descend only vertically. In this way, the inspection area 52 can be positioned close to, or separated from the nozzle plate 27.

In the embodiment described above, the upper ink absorber 55 and the lower ink absorber 56 are provided in the capping member 41. However, one or both of the upper ink absorber 55 and the lower ink absorber 56 may be omitted. For instance, only the electrode member 57 may be located inside the capping member 41 and ink may be ejected directly onto the electrode member 57. In addition, as a predetermined difference is generated between ink in the nozzle plate 27 and the electrode member 57, the upper ink absorber 55 need not necessarily be conductive, and the upper ink absorber 55 may be formed of an insulating material.

The embodiment is described above in the form of a full-color ink jet printer 20 which employs the ink jet method. However, the invention may also be applied to a multi-function printer incorporating a scanner, or a hybrid printer device such as a FAX machine or a copier. In addition, though the embodiment is described above in a form of a full-color ink jet printer 20, the invention may also be actualized in the form of a nozzle inspection device 50 that has a switch 53*a*.

The present application claims the benefit of priority from Japanese Patent Application No. 2005-354935 filed on Dec. 8, 2005, Japanese Patent Application No. 2005-354936 filed on Dec. 8, 2005, and Japanese Patent Application No. 2005-354937 filed on Dec. 8, 2005, the entire contents of all of which are incorporated herein by reference.

What is claimed is:

1. A print head nozzle inspection method for inspecting a nozzle of a print head of a printing device, the printing device including a print head with a plurality of nozzles for ejecting print recording liquid, a print recording liquid-receiving area that is capable of receiving print recording liquid ejected from the nozzles, and a switching module that is used to switch the status of the print head between being at ground potential and being independent from ground potential; said print head inspection method comprising the steps of:

(a) at the time of printing, driving the print head to eject print recording liquid while the print head is made at ground potential by use of the switching module; and (b) at the time of a nozzle inspection, generating a predetermined potential difference between the print head and the print recording liquid-receiving area while the print head is made independent from ground potential by use of the switching module, driving the print head to eject print recording liquid onto the print recording liquid-receiving area with the generated predetermined potential difference maintained, performs a nozzle inspection as to whether print recording liquid has been ejected from each of the nozzles in the print head based on results of detecting electrical change in the print recording liquid-receiving area or in the print head.

2. The print head inspection method according to claim 1, wherein, the step (a) controls the switching module to make the print head at ground potential, and the step (b) controls the switching module to make the print head independent from ground potential.

3. The print head inspection method according to claim 2, wherein the print recording liquid-receiving area is provided within a capping member that caps the nozzles when the print head contacts with the capping member, and the step (b) controls the switching module to make the print head independent from ground potential when the nozzle inspection is performed while the print head and the capping member are opposed to each other.

4. The print head inspection method according to claim 2, wherein the print recording liquid-receiving area is provided in a flashing area that is capable of receiving print recoding liquid ejected in a flashing process in which print recording liquid is forcibly ejected, and the step (b) controls the switching module to make the print head independent from ground potential when a nozzle inspection is performed while the print head and the flashing area are opposed to each other.

5. The print head inspection method according to claim 2, wherein the step (a) prohibits generation of the predetermined potential difference between the print head and the print recording liquid-receiving area at the time of controlling the switching module to make the print head at ground potential, and the step (b) generates the predetermined potential difference between the print head and the print recording liquid-receiving area at the time of controlling the switching module to make the print head independent from ground potential.

6. The print head inspection method according to claim 1, wherein the switching module switches the status of the print head between being at ground potential and being at a specific potential which is independent from ground potential and keeps the predetermined potential difference from potential of the recording liquid-receiving area.

7. A print head nozzle inspection device that inspects a nozzle of a print head, comprising:

a print head with a plurality of nozzles for ejecting print recording liquid;

a print recording liquid-receiving area that is capable of receiving print recording liquid ejected from the nozzles;

a print head driving module that drives the print head to eject the print recording liquid from the nozzles;

a potential difference generation module that makes the print head at a specific potential so as to generate a predetermined potential difference between the print head and the print recording liquid-receiving area;

a electrical change detection module that detects electrical change in the print head or the print recording liquid-receiving area;

a switching module that switches the status of the print head between being at ground potential and being independent from ground potential; and a control module that, at the time of printing, controls the print head driving module to drive the print head to eject print recording liquid for printing while the print head is made at ground potential by the switching module, and, at the time of a nozzle inspection, controls the potential difference generation module to generate the predetermined potential difference between the print head and the print recording liquid-receiving area while the print head is made independent from ground potential by the switching module, controls the print head driving module to drive the print head to eject print recording liquid onto the print recording liquid-receiving area with the generated predetermined potential difference maintained, and performs a nozzle inspection as to whether print recording liquid has been ejected from each of the nozzles in the print head based on electrical change detected by the electrical change detection module.

8. A printing device including:

a print head with a plurality of nozzles for ejecting print recording liquid; and the print head nozzle inspection device according to claim 7.

* * * * *